United States Patent [19]

Libregts et al.

[11] Patent Number: 4,618,202

[45] Date of Patent: Oct. 21, 1986

[54] CONNECTOR WITH STRAIN RELIEF

[75] Inventors: Hubertus B. Libregts, Vlijmen; Cornelis G. J. van Nes, Oisterwijk, both of Netherlands

[73] Assignee: E. I. Du Pont de Nemours and Company, Wilmington, Del.

[21] Appl. No.: 778,246

[22] Filed: Sep. 20, 1985

[30] Foreign Application Priority Data

Sep. 27, 1984 [NL] Netherlands ..... 8402949

[51] Int. Cl.[4] ..... H01R 4/24

[52] U.S. Cl. ..... 339/99 R; 339/107

[58] Field of Search ..... 339/97 R, 97 P, 98, 339/99 R, 107

[56] References Cited

U.S. PATENT DOCUMENTS

| | | | |
|---|---|---|---|
| 3,998,515 | 12/1976 | Hardesty | 339/99 R |
| 4,460,228 | 7/1984 | Lane et al. | 339/99 R |
| 4,506,944 | 3/1985 | Brennan et al. | 339/99 R |

FOREIGN PATENT DOCUMENTS

| | | |
|---|---|---|
| 160555 | 3/1933 | Switzerland . |
| 545692 | 6/1942 | United Kingdom . |
| 838241 | 7/1960 | United Kingdom . |

*Primary Examiner*—Joseph H. McGlynn

[57] ABSTRACT

Connector intended for attachment to the end of a cable consisting of one or more insulated conductors enclosed by a jacket, said connector comprising two housing parts which in the assembled state together define a passage having a first section designed to take the jacketed end of the cable, and a second section situated further in to take the insulated conductors projecting from the jacket. Both housing parts being provided at the first section with strain relief elements acting on the cable jacket in the assembled state, and one of the housing parts is provided at the second section with a pierce contact for each conductor. One housing part comprises in the second section of the passage cone-shaped teeth which in the assembled state project from the passage wall at right angles to the conductors and extend out to the passage wall of the other housing part in such a way that in the assembled state in the second section of the passage apertures are defined with a passage area which is smaller than the cross sectional area of the insulated conductors, so that a strain relief for each of the insulated conductors is formed.

6 Claims, 10 Drawing Figures

CONNECTOR WITH STRAIN RELIEF

BACKGROUND OF THE INVENTION

The invention relates to a connector intended for attachment to the end of a cable consisting of a number of insulated conductors enclosed by a jacket, said connector comprising two housing parts which in the assembled state together define a passage having—viewed from the insertion end—a first section designed to take the jacketed end of the cable, and a second section situated further in to take the insulated conductors projecting from the jacket, both housing parts being provided at the first section with strain relief elements acting on the cable jacket in the assembled state, and one of the housing parts is provided at the second section with a pierce contact for each conductor, which pierce contact can move from a position in which the insulated conductors can be introduced unimpeded into the second section of the passage to a position in which the pierce contact is at least partially pierced through the conductor in question.

Such a connector is known from U.S. Pat. No. 4,193,658. Each of the housing parts is provided with strain relief elements in the form of ribs which in the assembled state of the connector are pressed into the cable jacket, locally deform the cable jacket and thereby tightly grip the cable jacket. This release the strain on the cable jacket. During assembly, each of the pierce contacts is pushed in in such a way that the conductor in question is at least partially pierced through by the pierce contact.

In order also in the long run to guarantee good electrical contact between the pierce contact and the conductor in question, it is very important that the conductor should not be subjected to any mechanical tensile strain. During use of the cable with the connector attached to it, it is possible for the insulated conductor to move to some extent in the enclosing jacket, with the result that a tensile force is exerted on the conductor at the pierce contact, which means that a space can develop between the pierce contact and the conductor. This leads to impairment of the electrical contact, and the long run can lead to a complete electrical disconnection.

SUMMARY OF THE INVENTION

The object of the invention is now to improve this type of connector in such a way that for each of the individually insulated conductors a further strain relief is provided.

This object is achieved with a connector of the type referred to in the preamble by also making provision in a housing part at the second section of the passage for cone-shaped teeth which project from the passage wall in question, at right angles to the conductors at least in the cross sectional direction, and which in the assembled state of the connector extend out to the passage wall of the other housing part in such a way that in the assembled state in the said second section of the passage apertures are defined with a passage area which is smaller than the cross sectional area of the insulated conductors, so that the tooth walls in the assembled state of the connector grip the remaining insulation of the conductors in good order to form a strain relief for each of the insulated conductors.

It is pointed out that a connector provided with strain relief elements acting on the cable jacket and further strain relief elements acting on each of the insulated conductors is known from British Pat. No. 1,559,572. This known connector is, however, a type in which the housing is produced as one integral unit. Each of the strain relief elements there is achieved in the form of parts of the housing which can be shifted by means of a hinge effect or by means of deformation in such a way that the desired grip on the cable jacket or on the insulation of the individual conductors is obtained. The whole design of this connector housing is fairly complex and, in addition, special tools are needed to activate the various strain relieve elements.

According to a preferred embodiment of the invention, the connector is characterized in that the length of the above-mentioned teeth from the passage wall in question is greater than the corresponding cross section dimension of the second passage section, and apertures are provided in the wall of the other housing part which are of sufficient depth to take the ends of the teeth when the connector is in the assembled state. The dimensioning of the teeth is preferably chosen in such a way that the clamping action on the insulation of the conductors in question does not actually begin until the ends of the teeth go into the above-mentioned apertures in the wall of the other housing part. So individual apertures are first formed for each of the insulated conductors before the clamping action on the conductors begins, and jamming of any insulation part between the teeth ends and the opposite passage wall is therefore avoided.

It is preferable to design the projecting teeth as conical bodies of revolution, which ensures that no cutting into the insulation of the conductors occurs, but at most a deformation of it. Moreover, conically shaped teeth in an injection moulding process are advantageous from the point of view of shaping the moulds and detaching the particular housing part from the used mould.

According to a further preferred embodiment of the invention, the above-mentioned apertures in the other housing part are designed as blind bores, running from the outside wall of the housing part up to a very short distance from the second passage section, the thickness of the partition between the end of each blind bore and the second passage section being small enough to permit it to be pierced through by the projecting teeth during assembly of the connector.

This means that the wall of the second passage section is smooth and continuous during the introduction of the insulated conductors, so that this introduction can take place easily without obstructions.

The invention will be discussed in greater detail below with reference to the attached drawings.

BRIEF DESCRIPTION OF THE DRAWINGS

FIG. 3 shows a cross section through a connector according to the invention.

DESCRIPTION OF THE PREFERRED EMBODIMENTS

Figure 1:
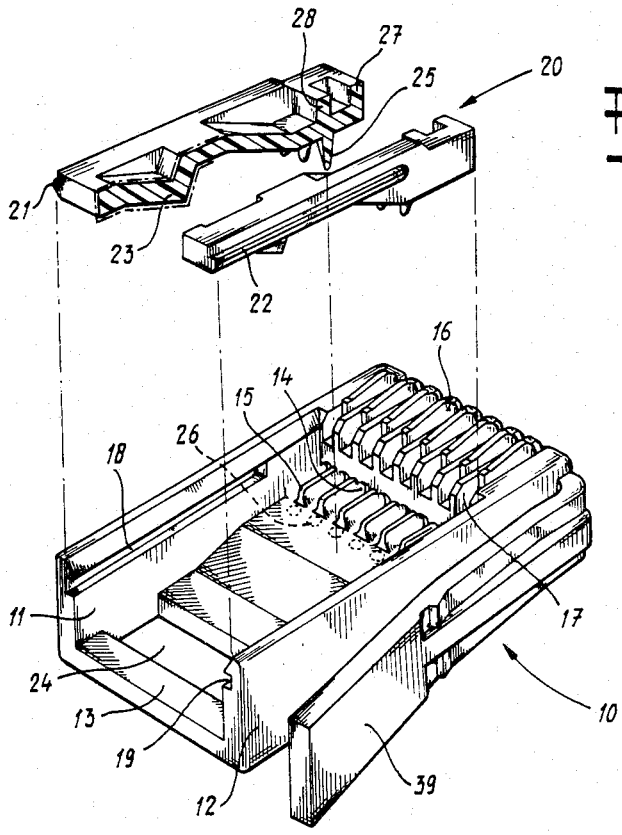
FIG. 1 shows the two housing parts of the connector according to the invention and indicates schematically the way in which these housing parts must fit into each other.

FIG. 1 shows schematically the two housing parts of the connector according to the invention: the base part 10 and the lid part 20. The base part 10 consists in general of a rectangular block of suitable material in which—again seen generally—there is a recess which is bounded by the upright walls 11 and 12 and by the bottom 13. As can be seen in FIG. 1, there is no further wall on the left side, while on the right side in FIG. 1 there is a relatively thick wall part in which a number of parallel apertures are provided, one of which is indicated by 14. These apertures can either be designed as blind apertures which do not run through completely to the right side of the base part, or they can also be designed as through-running passages. These apertures 14 are intended to take the individual insulated conductors of a jacketed cable. For better guiding of these conductors during the insertion, and for better positioning of them, provision is made immediately in front of the apertures 14 for a number of guide ribs, one of which is indicated by 15.

In the relatively wide wall section at the right end of the base part 10, provision is made for elongated apertures, in each of which a pierce contact is placed. One of these pierce contacts is indicated by 16 in the figure. For better guidance of these pierce contacts, upright partitions 17 are placed between the contacts. In FIG. 1, the contacts are shown in an upright position, in such a way that the piercing points on the underside of these pierce contacts 16 do not project into the corresponding apertures 14.

Disposed in the side walls 11 and 12 are grooves 18 and 19 running in the longitudinal direction, and the top part of the walls 11 and 12 is bevelled above these grooves 18 and 19.

The lid part 20 is provided, in the manner shown in FIG. 1, on the opposite longitudinal side walls with projecting ribs 21 and 22, the shape of which corresponds to that of the grooves 18 and 19. It will be clear from the figure that the lid part 20 on the top side can be pressed into the base part 10, in which case the bevelled edges 21 and 22 slide along the top bevelled parts of the walls 11 and 12 and snap into the grooves 18 and 19.

When the lid part 20 is joined to the base part 10, the two define in the left part of the assembled connector a passage to take the jacketed part of a cable. This jacketed part is gripped by strain relief elements consisting of a rib 23 on the underside of the lid 20 pointing towards a cavity 24 provided in the bottom 13 of the base part 10. This cavity 24 can consist of a blind cavity, in which case the base part 10 therefore has a closed underside, but it can also consist of a through-running passage, as shown schematically in FIG. 3. From FIG. 3 one can also see the way in which the jacket of the cable is gripped on the one side by the rib 23 of the lid 20 and, as a result, is partially deformed on the one side, while it is pushed down locally on the other side into the aperture 24. This provides a release of the strain on the cable jacket of the cable 30.

The lid part 20 is also provided with means for releasing the strain on the individual insulated conductors of the cable, in the form of a series of projecting teeth, one of which is specifically indicated by 25. These teeth 25 are positioned so that they are aligned with the ribs 15, in other words, positioned in such a way that the individual insulated conductors of the cable 30 which have to be inserted into the apertures 14 are between these teeth when the connector is in the assembled state. The length of these teeth 25 can be selected in such a way that when the connector is in the assembled state they end in a stub on or near the bottom wall 13 of the base part 10 of the connector. Such a design with stub teeth can, however, be used only if the individual insulated conductors are physically separated from one another at least where these teeth are located and, on the other hand, if stub teeth are used, one runs the risk that, during assembly of the connector, part of the insulation of one or more of the conductors in one way or another will become jammed between the underside of these teeth and the bottom 13 of the base part 10, which makes assembly of the connector difficult or impossible.

It is therefore preferable to have an embodiment in which the teeth 25 are longer than the distance between the underside of the lid part 20 and the top side of the bottom 13 of the base part 10 in the assembled state, said teeth in the assembled state projecting into the apertures 26 in the bottom 13 of the base part 10. In FIG. 1 only one of these apertures is indicated by the reference FIG. 26. Such an embodiment of the teeth has, on the one hand, the advantage that no clamping action whatsoever is exerted on the individual conductors at the time when the bottom tooth point penetrates into the corresponding aperture 26, so that good guidance of the teeth between the individual conductors, and thus good positioning of the conductors, is ensured while, on the other hand, it is possible to use these teeth in insulated conductors which are still connected to each other by means of thin material bridges, such as is the case, for example, with various types of flat cables. In that case the teeth must be designed in such a way that they are capable of penetrating these thin material bridges during assembly of the connector.

The lid part 20 will have to have a certain rigidity, on the one hand, in order to ensure that during pressing down of the lid part 20 into the base part 10 no inadmissible deformations do occur and, on the other hand, in the pressed-down state 20 the strain relief elements must perform their function with equal effect over the entire width of the connector without the lid bulging out as a result of the counterpressure exerted by the cable jacket or by the individual conductors and the effect of the strain relief elements in the middle of the connector being considerably less than near the side edges of the connector. In order to prevent this, the lid is profiled in cross section in such a way that sufficient rigidity is obtained. As can be seen clearly from FIG. 1 and FIG. 3, at the cable jacket strain relief elements, and in particular at the rib 23, the lid already essentially has adequate rigidity as far as shape is concerned, and no additional precautionary measures need to be taken here. At the teeth 25, however, the lid could in principle run flat, but a flat lid part has little rigidity and, in order to improve the rigidity at the teeth 25, a number of reinforcement ribs are integrally formed on the top side of the lid part 20. The figures illustrate two reinforcement ribs, indicated by 27 and 28.

Figure 4:
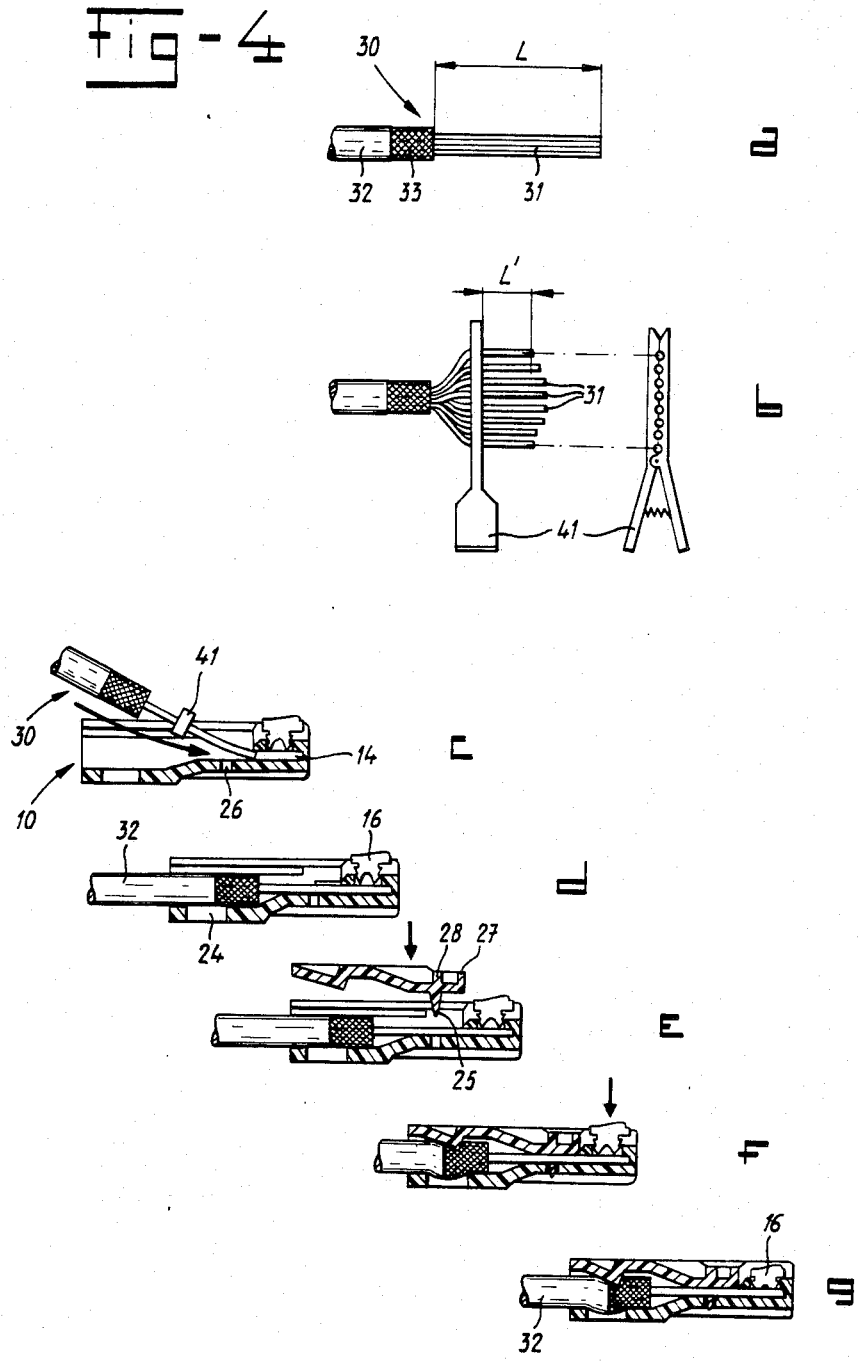
FIGS. 4*a–g* indicates schematically the way in which a connector according to the invention can be fitted to the end of a multicore cable.

It will now be indicated schematically with reference to FIGS. 4(*a–g*) how a cable end can be provided with a connector according to the invention. FIG. 4, (*a*) illustrates a cable 30 consisting of a number of insulated conductors 31 which are enclosed by a jacket 32. In this specific embodiment, the jacket 32 is also provided with an individual shield layer 33 which is partially exposed.

Over a length L the jacket 32 (including the shield layer 33) is stripped from the individual conductors 31.

If the cable 30 is a flat cable, its individual conductors can by nature be at distances from one another which correspond to the distances between the apertures 14 in the base part 10 of the connector. However, if this is not the case, the individual conductors can be held in the correct position as indicated in FIG. 4 at (*b*), for example with the aid of a separate clamping tool 34 in the form of a sort of clip. The clip must be positioned in such a way that the length L′ of the ends of the insulated conductors is sufficient to be inserted completely into the apertures 14. If all or some of the apertures 14 are blind, in other words, if the ends of the insulated conductors cannot come out again at the back of the connector, the ends of the insulated conductors must then be shortened to the length L′ indicated in FIG. 4-*b*.

In FIG. 4, (*c*) indicates the way in which the parallel-running end parts of the insulated conductors are then inserted into the apertures of the base part 10. It is pointed out that at this point in the assembly process all pierce elements 16 are in the upright position in which the piercing points at the bottom ends of these pierce elements 16 constitute no obstacle whatsoever for the insertion of the conductor ends into the apertures 14. The ribs 15 which can be seen in FIG. 1 serve as guide elements for the insulated conductor ends.

It will be clear from FIG. 4-*c* that the apertures 26 in the bottom 13 of the base part 10 could in some circumstances be an obstacle during insertion of the conductor ends. It is possible that the conductor ends could become jammed against the edges of these apertures. In order to avoid this, it is preferable for the apertures 26 to be designed as blind apertures running from the outside of the base part 10 and ending at a thin partition or a thin membrane which ensures a smooth surface on the inside of the bottom 16. The thickness of this thin partition or membrane must be chosen in such a way that the teeth 26 are easily able to penetrate this partition or membrane during pressing down of the lid. FIG. 3 shows the remainder of this membrane 29 after it has been pierced by a tooth 25.

In FIG. 4, at stage (*d*) the cable is positioned in such a way that its jacket 32 is located in the correct position on the floor of the base part 10.

In a subsequent stage, indicated in FIG. 4 at (*e*), the lid part 20 is pressed downwards into the base part 10 until the snap edges 21 and 22 snap into the grooves 18 and 19. During pressing down of the lid part 20, the teeth 25, after piercing trough any partitions or membranes 29, will be guided into the apertures 26 in the floor 13. The teeth, at least when seen in the crosswise direction of the connector, have preferably a conical shape, in other words, the free space between the teeth decreases as the section of the finally remaining space between each pair of teeth is smaller than the cross section of the insulated conductor and therefore the side edges of each pair of teeth facing one another in each case penetrate into the insulation of the conductor which is clamped between the teeth in question. As a result, this insulation is partially deformed and a firm grip is obtained on the conductor in question, which means that the strain is released from this conductor.

Although various embodiments of the teeth are possible, it is preferable for the teeth to be designed entirely conical, so that the walls penetrating into the insulation of the individual conductors have a smooth shape and there is no cutting into the insulation in question. Furthermore, if an injection moulding process or similar process is used to produce the connector housing parts, smooth conical teeth are an advantage from the point of view of shaping the moulds required for such an injection moulding process, and they will also be advantageous when detaching the shaped housing part from the injection mould.

The next stage in the assembly process, indicated in FIG. 4 at (*f*), consists of pressing the piercing elements 16 into the position which is illustrated in FIG. 3. In this position the points 16*a* and 16*b* are piercing through the insulating layer 35 of the conductor 31 and through its central conducting element 34, so that good contact is made between the conducting pierce element 16 and the conducting inside element 34 of the insulated conductor 31. The position finally reached is also shown schematically in FIG. 4 at (*g*).

In FIG. 3, reference FIG. 40 indicates a conducting layer which is provided on at least part of the surface of the lid part 20, and which can also be persent on at least part of the surface of the base part 10. As can be seen from FIG. 3, the strain relief rib 23 will penetrate during the assembly procress so far into the cable jacket 32 of the cable 30 that this rib comes into contact with the shield layer 33. If this rib is now provided at least locally with a conducting layer, contact can be made in this way between a shielding part of the connector and the shield layer in the cable jacket.

Figure 2:
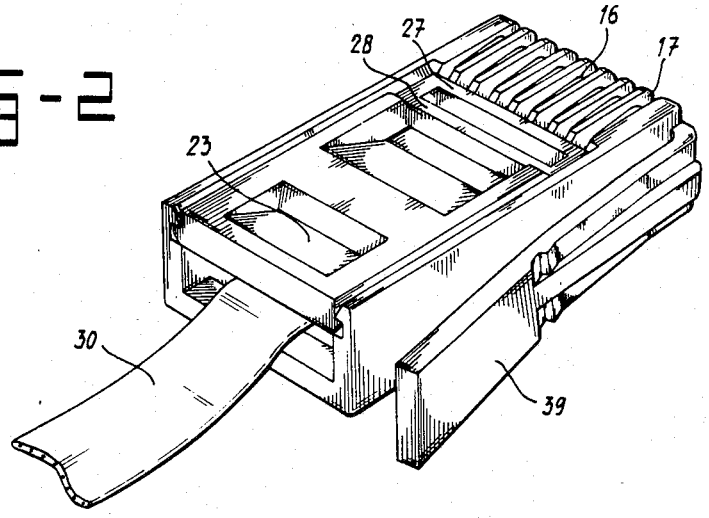
FIG. 2 shows an assembled connector according to the invention.
Figure 7:
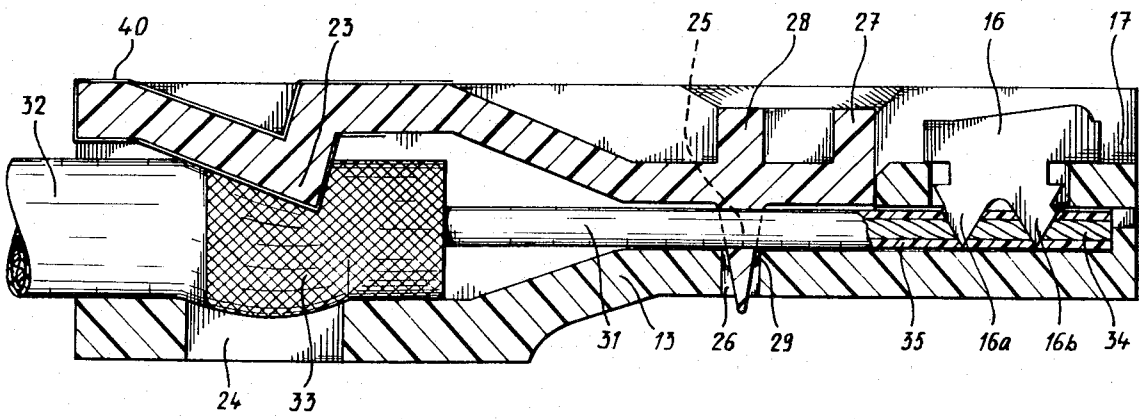

FIGS. 1 and 2 also show a clamping element 39 on the side edge of the connector, but it will not be discussed in detail. This clamping element 39 serves to hold the connector in a matching connector housing. Details of such holding elements can be found, for example, in the earlier mentioned publications.

It will be clear from the above that the invention provides strain relief elements for releasing the strain from the individual conductors in a connector according to the invention. If one uses a cable with a connector on its end, it is conceivable that—in particular at the end of the cable which is introduced into the connector—movement will occur in the longitudinal direction between the cable jacket and the elements 16 and the individual inside conductors 34 is realised by means of the points parts 16*a* and 16*b* of the pierce through elements 16, it will be clear from FIG. 3 that a slight strain on the inside conductor both left and right can result in space between the teeth of the pierce element 16 and the inside conductor 34, which results in an impaired contact between the two or a complete disconnection. The strain relief elements mentioned above, in particular formed by the teeth 25, now ensure that any strains exerted on the left side in FIG. 3 on the individual insulated conductors will not be transferred to the contact junction.

Although the invention is described above with special reference to a special embodiment thereof, it will be clear that various modifications and changes are possible within the scope of the invention.

We claim:

1. A connector intended for attachment to the end of a cable having one or more insulated conductors enclosed by a jacket, said connector comprising:

two housing parts which, when assembled, define a passage having a first section adapted to accept the end portion of the cable jacket and a second section adapted to accept the insulated conductors projecting from the jacket, each housing part being provided at the first section of the passage with strain relief means intended to act on the cable jacket, one of said housing parts being provided at the second section of the passage with a pierce contact for each conductor, each said pierce contact being movable from a first position in which the insulated conductors can be introduced unimpeded into the second section of the passage to a second position in which each conductor is at least partially pierced by its respective pierce contact, another of said housing parts being provided at the second section of the passage with cone-shaped teeth which, when the housing parts are assembled, project from the wall of the passage defined by said other housing part into the passage at right angles to the conductors and extend to the wall of the passage defined by said one housing part, said projecting teeth defining apertures in the passage which are smaller than cross-sectional area of the insulated conductors so that the teeth grip the insulation surrounding the conductors, thereby providing strain relief for each insulated conductor.

2. A connector according to claim 1, wherein the projecting teeth are designed as conical bodies of revolution.

3. A connector according to claim 1 intended for attachment to the end of a flat cable having material which bridges between the conductors, wherein the distance between the projecting teeth corresponds to the distance between the conductors of the flat cable, and wherein the dimensions of the teeth are chosen in such a way that in the assembled state the teeth pass through material between the various conductors without coming into contact with the actual conductors.

4. A connector according to claim 1, wherein said other housing part provided with the projecting teeth is also provided with one or more reinforcement ribs on its outside wall approximately opposite the teeth projecting from its inside wall.

5. A connector according to claim 1, wherein the length of the teeth is greater than the corresponding cross sectional dimension of the second passage section, and disposed in the wall of said one housing part are apertures of sufficient depth to take the ends of the teeth when the connector is in the assembled state.

6. Connector according to claim 5, wherein said apertures in said one housing part are designed as blind bores running from the outside wall of said one housing part to a very short distance from the second passage section and including a partition wall therebetween, the thickness of the partition wall between the end of each blind bore and the second passage section being small enough to be pierced through by the projecting teeth during assembly of the connector.

* * * * *